US008138848B2

(12) United States Patent
Lingel

(10) Patent No.: US 8,138,848 B2
(45) Date of Patent: Mar. 20, 2012

(54) CIRCULATOR/ISOLATOR WITH AN ASYMMETRIC RESONATOR

(75) Inventor: Thomas Lingel, Fayetteville, NY (US)

(73) Assignee: Anaren, Inc., East Syracuse, NY (US)

( * ) Notice: Subject to any disclaimer, the term of this patent is extended or adjusted under 35 U.S.C. 154(b) by 315 days.

(21) Appl. No.: 12/611,517

(22) Filed: Nov. 3, 2009

(65) Prior Publication Data

US 2010/0109791 A1 May 6, 2010

Related U.S. Application Data

(60) Provisional application No. 61/110,782, filed on Nov. 3, 2008.

(51) Int. Cl.
*H01P 1/387* (2006.01)

(52) U.S. Cl. ..... 333/1.1

(58) Field of Classification Search ..... 333/1.1, 333/24.2

See application file for complete search history.

(56) References Cited

U.S. PATENT DOCUMENTS 3,513,413 A * 5/1970 Nakahara et al. ..... 333/1.1
3,701,054 A * 10/1972 Hagler et al. ..... 333/1.1
3,854,106 A * 12/1974 Tresselt ..... 333/1.1

* cited by examiner

*Primary Examiner* — Stephen Jones

(74) *Attorney, Agent, or Firm* — Daniel P. Malley; Bond Schoeneck & King

(57) ABSTRACT

The present invention is directed to a circulator device that includes a housing defining an interior three-dimensional volume. The housing includes a plurality of port openings disposed therein. A gyromagnetic resonator stack is disposed in the housing. The gyromagnetic resonator stack includes a circuit disposed between a first ferrite disk and a second ferrite disk. The first ferrite disk and the second ferrite disks form a pair of ferrite disks having a ferrite disk centroid and a ferrite disk perimeter. The circuit including an asymmetric center resonator having a eccentric region characterized by a predetermined resonator geometry. The circuit further including an impedance matching transmission line structure coupled to an edge of the eccentric region proximate the ferrite disk perimeter and at least one 50 Ohm transmission line structure coupled to a non-eccentric portion of the asymmetric center resonator. Each of the impedance matching transmission line structure and the at least one 50 Ohm transmission line structure extending through corresponding port openings of the plurality of port openings. The impedance matching transmission line structure is characterized by a section geometry and a predetermined matching impedance. The predetermined matching impedance is a function of the section geometry and at least one performance parameter of the device is a function of the predetermined resonator geometry.

21 Claims, 1 Drawing Sheet

CIRCULATOR/ISOLATOR WITH AN ASYMMETRIC RESONATOR

CROSS-REFERENCE TO RELATED APPLICATIONS

The instant application claims priority to U.S. Provisional Patent Application Ser. No. 61/110,782 filed on Nov. 3, 2008, the content of which is relied upon and incorporated herein by reference in its entirety.

BACKGROUND OF THE INVENTION

1. Field of the Invention

The present invention relates generally to passive microwave devices, and particularly to microwave circulator/isolator devices.

2. Technical Background

A ferrite circulator/isolator is a passive multi-port microwave device that is typically employed in RF transmission line applications such as radar, cell phone applications, etc. The ferrite circulator/isolator device is typically used to provide a low loss transmission path for RF energy in one direction and substantially prevent any transmission of energy in the reverse direction. If a reflected RF signal or some other RF signal is permitted to propagate in the reverse direction, an unprotected signal source may be significantly damaged. The ferrite circulator/isolator device is configured to attenuate such RF transmissions to thereby prevent such damage from occurring.

A typical ferrite circulator includes three outgoing ports, and is generally referred to as a junction circulator. In operation, when an RF signal is directed into a first port, the RF signal will be accessible via the second port in sequence, i.e., the port immediately adjacent to the input port. Accordingly, the RF signal will be substantially attenuated and will not be available at the third port in the sequence, that is, the port immediately adjacent to the second port on the other side of the first input port. A circulator, therefore, propagates RF power from one adjacent port to the next in a sequential, circular fashion. The RF signal circulation may be right-handed (RH) or left-handed (LH).

When an RF signal is directed into the input port of the circulator, circulating phase shifted versions of the RF signal are induced within the ferrite discs. At an operation frequency range the degree of phase shift between counter circulating fields is a function of the strength of the DC magnetic field and diameter of the ferrite material. The circulator operates in accordance with the principles of superposition and constructive/destructive interference of counter-rotating RF waves. Using the example from above, when an RF signal is directed into the first port, the counter circulating RF signals are substantially in phase with each other at the second port, and therefore, they constructively interfere and reinforce each other. The amount of signal available at the second port as compared with the input signal is measured by what is commonly referred to as the insertion loss. At the third port, the RF signals are out of phase with each other and substantially cancel each other. The term "substantially" refers to the fact that, in practice, the cancellation is not perfect and a residual signal may be detected. The amount of residual signal available at the third port is measured by the degree of isolation (dB).

Insertion loss is so named because it represents the loss of signal power associated with inserting the device into the signal path. In a properly functioning device the insertion loss is typically in the range of a few tenths of a decibel (dB). At the third port, the RF signals are out of phase with each other and substantially cancel each other. As alluded to above, the amount of residual signal available at the third port, appropriately referred to as the "isolation," is measured by the ratio of the residual signal and the incident signal. The isolation is typically between −25 dB and −30 dB. Another parameter frequently discussed in the art is known as return loss. Return loss relates to the amount of signal power that is reflected when the device is inserted into the signal path. Return loss is also typically expressed in decibels (dB). As those of ordinary skill in the art will appreciate, signal reflections are introduced when there is an impedance mismatch at the junction of two signal paths.

A junction circulator includes both electrical and magnetic circuit components and may be implemented using either a stripline or microstrip transmission line configuration. The first sub-assembly discussed herein is referred to as the central stack assembly. The electrical portion of the central stack includes a flat conductor, circuit junction. The circuit junction is sandwiched between a pair of ferrite discs. The outer surface of both the top ferrite disc and bottom ferrite disc are in contact with ground planes to thereby form a stripline configuration. A permanent magnet is disposed over each ground plane. The permanent magnets apply a predetermined magnetic field to bias the ferrite discs normal to plane. A steel pole member may be inserted between each ground plane/magnet pair. The function of the steel pole member is to ensure that the biasing magnetic field applied to the ferrites is substantially uniform. The magnetic properties of both the ferrite material and the magnet may result in temperature variations. Therefore, the central stack may also include thermal compensators that are configured to ensure that the thermal stability of the circulator is maintained. The thermal compensators, which may be fabricated using nickel alloys, offset the aforementioned temperature variations.

A circulator may be configured as an isolator by terminating one of the ports with a "matched load." In implementing a matched load, RF engineers ensure that, from an impedance standpoint, the complex impedance of the load is the complex conjugate of the output port impedance. As noted above, an isolator permits RF signal propagation between the two remaining ports in one direction only. RF power flow in the opposite direction is substantially inhibited. Now that the general operating principles have been briefly touched upon, a similarly brief description of the matching structure of a junction circulator is provided.

The circuit junction is composed of a center resonator and three branches extending symmetrically outward from the central conductive portion. The three branches known in the art as impedance transformers function as the ports of circulator and are positioned 120° apart from each other. It is known that the impedance of the center resonator itself is usually well below of 50 Ohms. At the same time, the circulators and isolators are utilized in the systems with characteristic impedance of 50 Ohms. The transformation of low impedance at center resonator to 50 Ohms at ports is usually realized by appropriately designing the geometry of outgoing transformer branches. In Wye-type circulators the center resonator and outgoing transformer sections are formed to fit within the area covered by ferrite discs. Incorporating transformer section within ferrite area allows for a substantial reduction in the size of circulator. Generally all three circulator ports have the same impedance value. Therefore, the symmetry considerations require the transformer branches to be the same for all ports and the center resonator to be aligned with the symmetry axis of ferrite discs. In some applications, like an isolator with an external load, the impedance of a device connected to the circulator may deviate from 50 Ohms. If the deviation is small, the matching is realized by modifying the appropriate transformer section to bring the impedance of the particular port to match that of connected device. If, however, the impedance of device deviates substantially from 50 Ohms, as is a case of high power transistor, the aforementioned modification does not typically provide a suitable result. The use of additional external transformers has drawbacks because the external transformers tend to increase the size of device and introduce additional losses of power.

What is needed, therefore, is a circulator/isolator that is designed having an internal feature that provides matching in case when the impedance requirement for one port is substantially different than that for other two ports.

SUMMARY OF THE INVENTION

The present invention addresses the needs described above by providing a circulator/isolator that includes an asymmetric resonator and transmission structure that provides an impedance at the input port that is the conjugate match of the output impedance of the preceding device without additional transformation structures. The outputs of the circulator are matched internally to common transmission line impedances (typically close to 50 Ohm). This allows one to eliminate transformation structures and their respective losses.

One embodiment of the present invention is directed to a circulator device that includes a housing defining an interior three-dimensional volume. The housing includes a plurality of port openings disposed therein. A gyromagnetic resonator stack is disposed in the housing. The gyromagnetic resonator stack includes a circuit disposed between a first ferrite disk and a second ferrite disk. The first ferrite disk and the second ferrite disks form a pair of ferrite disks having a ferrite disk centroid and a ferrite disk perimeter. The circuit including an asymmetric center resonator having a eccentric region characterized by a predetermined resonator geometry. The circuit further including an impedance matching transmission line structure coupled to an edge of the eccentric region proximate the ferrite disk perimeter and at least one 50 Ohm transmission line structure coupled to a non-eccentric portion of the asymmetric center resonator. Each of the impedance matching transmission line structure and the at least one 50 Ohm transmission line structure extending through corresponding port openings of the plurality of port openings. The impedance matching transmission line structure is characterized by a section geometry and a predetermined matching impedance. The predetermined matching impedance is a function of the section geometry and at least one performance parameter of the device is a function of the predetermined resonator geometry.

Another aspect of the present invention is directed to a circulator device that includes a housing defining an interior three-dimensional volume. The housing includes a plurality of port openings disposed therein. A gyromagnetic resonator stack is disposed in the housing. The gyromagnetic resonator stack includes a circuit disposed between a pair of ferrite disks that include a ferrite centroid and a ferrite disk perimeter. The circuit includes an asymmetric center resonator having a eccentric region characterized by a predetermined resonator geometry and a resonator centroid. The resonator centroid is offset from the ferrite centroid by a predetermined offset distance. The circuit further includes an impedance matching transmission line structure coupled to an edge of the eccentric region proximate the ferrite disk perimeter and at least one 50 Ohm transmission line structure coupled to a non-eccentric portion of the asymmetric center resonator. Each of the impedance matching transmission line structure and the at least one 50 Ohm transmission line structure extends through corresponding port openings of the plurality of port openings. The impedance matching transmission line structure is characterized by a section geometry and a predetermined matching impedance. The predetermined matching impedance is a function of the section geometry and at least one performance parameter of the device is a function of the predetermined resonator geometry.

Yet another aspect of the present invention is directed to an RF assembly that includes an RF component characterized by a first impedance and a circulator device. The circulator device includes a housing that defines an interior three-dimensional volume. The housing includes a plurality of port openings disposed therein. A gyromagnetic resonator stack is disposed in the housing. The gyromagnetic resonator stack includes a circuit disposed between a first ferrite disk and a second ferrite disk. The first ferrite disk and the second ferrite disks form a pair of ferrite disks having a ferrite disk centroid and a ferrite disk perimeter. The circuit including an asymmetric center resonator having a eccentric region characterized by a predetermined resonator geometry. The circuit further including an impedance matching transmission line structure coupled to an edge of the eccentric region proximate the ferrite disk perimeter and at least one 50 Ohm transmission line structure coupled to a non-eccentric portion of the asymmetric center resonator. Each of the impedance matching transmission line structure and the at least one 50 Ohm transmission line structure extending through corresponding port openings of the plurality of port openings. The impedance matching transmission line structure is characterized by a section geometry and a predetermined matching impedance. The predetermined matching impedance is a function of the section geometry and at least one performance parameter of the device is a function of the predetermined resonator geometry.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments of the invention, and together with the description serve to explain the principles and operation of the invention.

DETAILED DESCRIPTION

Figure 1:
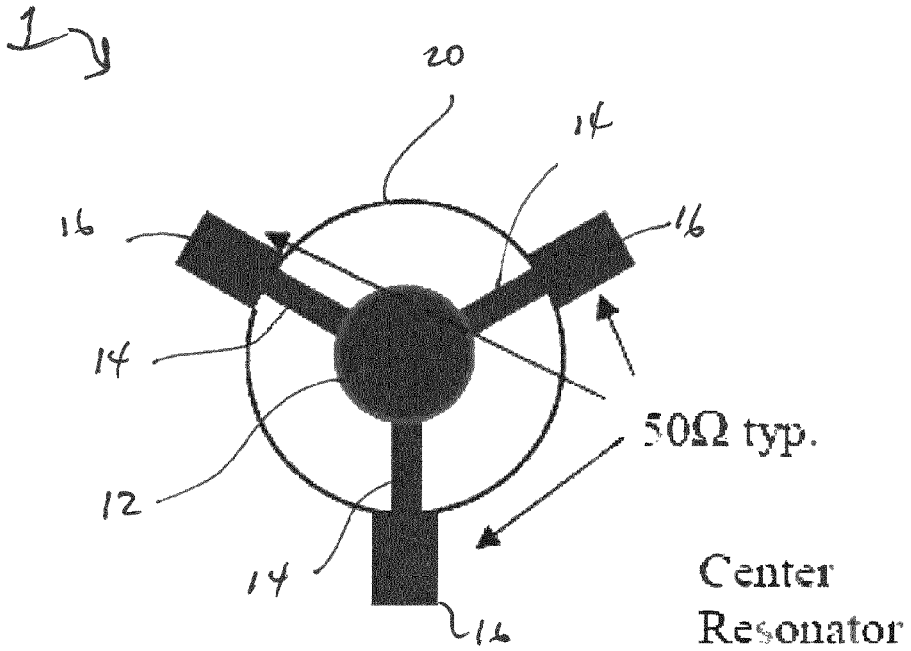
CONVENTIONAL ART Figure 1
FIG. 1 is a plan schematic view of a conventional circulator/isolator device.

Reference will now be made in detail to the present exemplary embodiments of the invention, examples of which are illustrated in the accompanying drawings. Wherever possible, the same reference numbers will be used throughout the drawings to refer to the same or like parts. An exemplary embodiment of the circulator of the present invention is shown in FIG. 2, and is designated generally throughout by reference numeral 10.

Referring to FIG. 1, a plan schematic view of a conventional circulator/isolator device 1 is shown. As explained previously, circulators and isolators are usually designed to work in a 50 Ohm system. The circuit portion of the device is a metallic element that includes a central substantially circular center resonator 12 with three transformer sections 14 extending from center resonator and spaced at 120° intervals. Those of ordinary skill in the art will understand that the conventional center resonator 12 may not be circular in shape. In many instances, it includes tuning stubs disposed between the transformer sections 14. These tuning stubs (not shown) very often are triangular in shape. The key concept relates to the position of the center resonator 12 in conventional devices, which in this case, is substantially aligned with the origin of the circle formed by the ferrite disks 20. The center resonator 12 and transformer sections 14 are sandwiched between a pair of ferrite disks 20 in the central stack of the circulator 1. As noted above, the conventional device 1 shown in FIG. 1 typically requires the use of additional transformation stages to effect the necessary impedance transformation required for use with the low impedance transistor elements described above in the background section of this patent. When a transformation to very low impedance is necessary, the width of required transformer section is wide and close to the length of transformer section. As those of ordinary skill in the art will appreciate, such transformer does not ensure proper impedance transformation.

Figure 2:
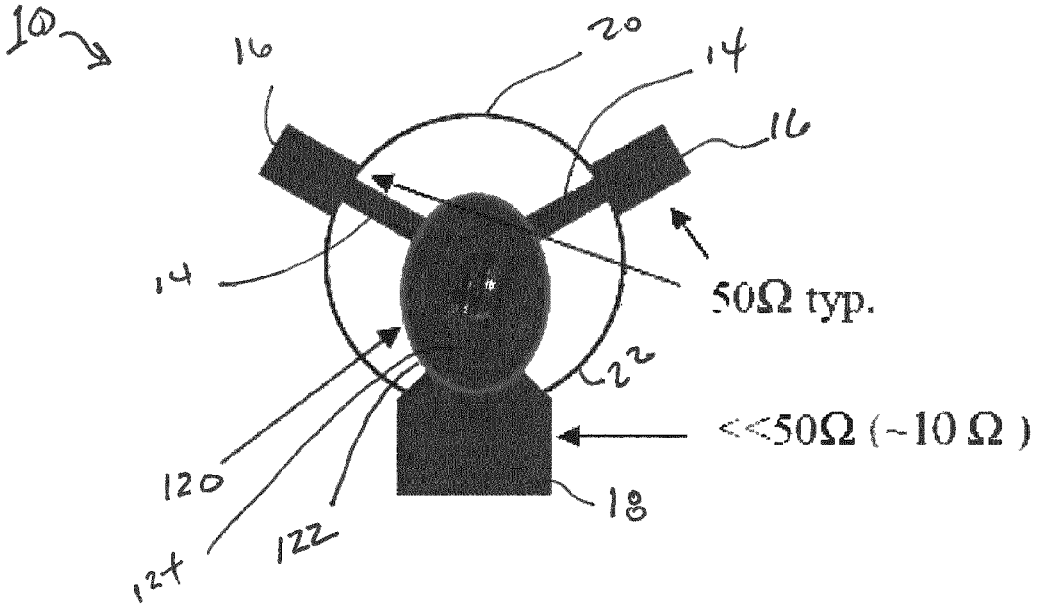
FIG. 2 is a plan schematic view of a circulator/isolator device in accordance with an embodiment of the present invention.

As embodied herein, and depicted in FIG. 2, a plan schematic view of a circulator/isolator device 10 in accordance with an embodiment of the present invention is disclosed. As described in detail below, the present invention is directed to a circulator/isolator that includes an asymmetric resonator and transmission structure that provides an impedance at the input port that is the conjugate match of the output impedance of the preceding device without additional transformation structures.

In the schematic view, center resonator 120 is positioned between ferrite disks 20. There are two output ports 16 of the circulator that are positioned 120° apart from each other. A third output port 18 is positioned 120° apart from the 50 Ohm ports 16. The 50 Ohm ports 16 are connected to the center resonator 120 through appropriate impedance transformation transmission lines 14 which ensure transformation of low impedance at the edge of center resonator 120 to a 50 Ohm impedance. The bottom port 18, is directly matched with the output of the low impedance device (e.g., transistor) since it is disposed proximate to the periphery 122 of center resonator 120. The center resonator 120 has a deformed or eccentric portion 124 that is reshaped relative to the resonator device shown in FIG. 1. Suffice it to say that it is a feature of the present invention that is employed to effect the desired impedance transformation at reasonable levels of performance.

The principles of the present invention were derived empirically with the following factual underpinnings clearly in mind. First, the impedance of resonator (12, 120) at the periphery 122 is typically low (e.g., <10 Ohm). The conventional resonator 12 must be connected to the 50 Ohm transmission line 16 via an internal impedance transformation section 14 to obtain 50 Ohm terminal impedance. Both the resonator 12 and the transformation sections 14 are disposed within the ferrite diameter. In accordance with the teachings of the present invention, a device with a very low output impedance (e.g., <10 Ohm) may be directly connected to the resonator via a short impedance matching section 18. In other words, a circulator 10 may implemented that exhibits both the desired impedance matching characteristics and acceptable insertion loss characteristics. The first step in the design process is to eliminate the transformer section 14 of the port being modified to match the low impedance device. Next, the transmission line 18 is empirically set to the desired impedance by varying the section geometry to provide the proper match.

Finally, the geometry of the center resonator 120, the position of the resonator 120 centroid, and the edge 122 of the resonator relative to the ferrite disk perimeter are adjusted while optimizing the device's return loss and/or insertion loss performance. In doing so, the center resonator 120 exhibits an asymmetric geometry such that eccentric portion 124 extends to the periphery 22 of the ferrite disks 20. The asymmetric configuration may have an impact on other design parameters as well. For example, the performance and bandwidth at the output ports will be different. However, these parameters may be optimized by using any suitable simulation tool available to those skilled in the art to vary the geometry of the resonator 120, eccentric portion 124 and/or the geometry of impedance matching section 18. Note that deforming the resonator brings the edge of the center resonator up to the ferrite disk perimeter at the low impedance port; the impedance of the resonator near the edge of the ferrite perimeter is close to the desired external impedance. The impedance matching structure 18 provides an impedance at the input port that is the conjugate match of the output impedance of the preceding device without additional transformation structures. The geometry of transmission line structure 18 is empirically varied to drive the impedance to a higher or a lower value as needed. In the example depicted in FIG. 2, transmission structure 18 is shown as being a relatively wide structure having an impedance of approximately 10 Ohms. The impedance may be increased to values greater than 50 Ohms by narrowing the width of the transmission structure 18 to an appropriate width.

Note that in reference to the central stack 120, the outer surface of both the top ferrite disk 20 and bottom ferrite disk 20 are in contact with ground planes (not shown in FIG. 2) to implement a stripline configuration. A permanent magnet (not shown in FIG. 2) is disposed over each ground plane. The permanent magnets apply a predetermined magnetic field to bias the ferrite disks 20 in a predictable manner. A steel pole (not shown in FIG. 2) member may be inserted between each ground plane/magnet pair. The function of the steel pole member is to ensure that the biasing magnetic field applied to the ferrites is substantially uniform. The magnetic properties of both the ferrite material and the magnet may result in temperature variations. Therefore, the central stack may also include thermal compensators (not shown in FIG. 2) that are configured to ensure that the thermal stability of the circulator is maintained. The thermal compensators, which may be fabricated using nickel alloys, offset the aforementioned temperature variations. The above described stack is enclosed within a housing made of a ferrous metal to provide a magnetic return path for the magnetic flux generated by the permanent magnet.

Those of ordinary skill in the art will also understand that the present invention may be employed using micro-strip circulators/isolators because circulators of this type are usually realized by using a resonating center structure, connected to the terminals with transmission lines.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening.

The recitation of ranges of values herein are merely intended to serve as a shorthand method of referring individually to each separate value falling within the range, unless otherwise indicated herein, and each separate value is incorporated into the specification as if it were individually recited herein.

All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not impose a limitation on the scope of the invention unless otherwise claimed.

No language in the specification should be construed as indicating any non-claimed element as essential to the practice of the invention.

It will be apparent to those skilled in the art that various modifications and variations can be made to the present invention without departing from the spirit and scope of the invention. There is no intention to limit the invention to the specific form or forms disclosed, but on the contrary, the intention is to cover all modifications, alternative constructions, and equivalents falling within the spirit and scope of the invention, as defined in the appended claims. Thus, it is intended that the present invention cover the modifications and variations of this invention provided they come within the scope of the appended claims and their equivalents.

The invention claimed is:

1. A circulator device comprising:

a housing defining an interior three-dimensional volume, the housing including a plurality of port openings disposed therein; and a gyromagnetic resonator stack disposed in the housing, the gyromagnetic resonator stack including a circuit disposed between a first ferrite disk and a second ferrite disk, the first ferrite disk and the second ferrite disks form a pair of ferrite disks having a ferrite disk centroid and a ferrite disk perimeter, the circuit including an asymmetric center resonator having a eccentric region characterized by a predetermined resonator geometry, the circuit further including an impedance matching transmission line structure coupled to an edge of the eccentric region proximate the ferrite disk perimeter and at least one 50 Ohm transmission line structure coupled to a non-eccentric portion of the asymmetric center resonator, each of the impedance matching transmission line structure and the at least one 50 Ohm transmission line structure extending through corresponding port openings of the plurality of port openings, the impedance matching transmission line structure being characterized by a section geometry and a predetermined matching impedance, the predetermined matching impedance being a function of the section geometry and at least one performance parameter of the device being a function of the predetermined resonator geometry.

2. The device of claim 1, wherein the at least one parameter includes a return loss parameter, a device insertion loss parameter or a bandwidth parameter.

3. The device of claim 1, wherein a resonator centroid of the asymmetric center resonator is offset from a ferrite centroid of the pair of ferrite disks.

4. The device of claim 1, wherein each at least one 50 Ohm transmission line structure comprises an internal impedance transformation section connected to the non-eccentric region at a first end thereof and a 50 Ohm transmission line connected to an opposite end thereof.

5. The device of claim 4, wherein the at least one 50 Ohm transmission line structure includes a first 50 Ohm transmission line structure and a second 50 Ohm transmission line structure separated by 120°, and wherein the low impedance transmission line structure is separated from each of the first 50 Ohm transmission line structure and the second 50 Ohm transmission line structure by 120°.

6. The device of claim 1, wherein the predetermined matching impedance is substantially less than 50 Ohms.

7. The device of claim 6, wherein the predetermined matching impedance is less than or equal to approximately 10 Ohms.

8. The device of claim 1, wherein the housing includes a first ground plane disposed adjacent an outer surface of the first ferrite disk and a second ground plane disposed adjacent an outer surface of the second ferrite disk to implement a stripline configuration.

9. The device of claim 8, wherein the housing includes a first permanent magnet disposed proximate the first ground plane and a second permanent magnet disposed proximate the second ground plane, each of the first permanent magnet and the second permanent magnet being configured to apply a predetermined magnetic field.

10. The device of claim 1, wherein the housing includes a plurality of thermal compensators disposed therein.

11. The device of claim 10, wherein the plurality of thermal compensators are fabricated using a nickel alloy material.

12. The device of claim 1, wherein the predetermined matching impedance is greater than 50 Ohms.

13. The device of claim 12, wherein a first steel pole component is disposed between the first ground plane and the first permanent magnet, and a second steel pole component is disposed between the second ground plane and the second permanent magnet.

14. The device of claim 12, wherein the housing is comprised of a ferrous metal material and is configured to provide a magnetic return path for the magnetic flux generated by the first permanent magnet and the second permanent magnet.

15. A circulator device comprising:

a housing defining an interior three-dimensional volume, the housing including a plurality of port openings disposed therein; and a gyromagnetic resonator stack disposed in the housing, the gyromagnetic resonator stack including a circuit disposed between a pair of ferrite disks that include a ferrite centroid and a ferrite disk perimeter, the circuit including an asymmetric center resonator having a eccentric region characterized by a predetermined resonator geometry and a resonator centroid, the resonator centroid being offset from the ferrite centroid by a predetermined offset distance, the circuit further including an impedance matching transmission line structure coupled to an edge of the eccentric region proximate the ferrite disk perimeter and at least one 50 Ohm transmission line structure coupled to a non-eccentric portion of the asymmetric center resonator, each of the impedance matching transmission line structure and the at least one 50 Ohm transmission line structure extending through corresponding port openings of the plurality of port openings, the impedance matching transmission line structure being characterized by a section geometry and a predetermined matching impedance, the predetermined matching impedance being a function of the section geometry and at least one performance parameter of the device being a function of the predetermined resonator geometry.

16. The device of claim 15, wherein the predetermined matching impedance is greater than 50 Ohms.

17. The device of claim 15, wherein the at least one parameter includes a return loss parameter, a device insertion loss parameter, or a bandwidth parameter.

18. The device of claim 17, wherein the at least one 50 Ohm transmission line structure includes a first 50 Ohm transmission line structure and a second 50 Ohm transmission line structure separated by 120°, and wherein the low impedance transmission line structure is separated from each of the first 50 Ohm transmission line structure and the second 50 Ohm transmission line structure by 120°.

19. The device of claim 15, wherein the predetermined matching impedance is substantially less than 50 Ohms.

20. The device of claim 19, wherein the predetermined matching impedance is less than or equal to approximately 10 Ohms.

21. An RF assembly comprising:

an RF component characterized by a first impedance; and a circulator device including, a housing that defines an interior three-dimensional volume, the housing including a plurality of port openings disposed therein, and a gyromagnetic resonator stack disposed in the housing, the gyromagnetic resonator stack including a circuit disposed between a first ferrite disk and a second ferrite disk, the first ferrite disk and the second ferrite disks form a pair of ferrite disks having a ferrite disk centroid and a ferrite disk perimeter, the circuit including an asymmetric center resonator having a eccentric region characterized by a predetermined resonator geometry, the circuit further including an impedance matching transmission line structure coupled to an edge of the eccentric region proximate the ferrite disk perimeter and at least one 50 Ohm transmission line structure coupled to a non-eccentric portion of the asymmetric center resonator, each of the impedance matching transmission line structure and the at least one 50 Ohm transmission line structure extending through corresponding port openings of the plurality of port openings, the impedance matching transmission line structure being characterized by a section geometry and a predetermined matching impedance, the predetermined matching impedance being a function of the section geometry and at least one performance parameter of the device being a function of the predetermined resonator geometry.

* * * * *